US008172558B2

(12) United States Patent
Hasegawa et al.

(10) Patent No.: US 8,172,558 B2
(45) Date of Patent: May 8, 2012

(54) ROTARY EXPANDER WITH DISCHARGE AND INTRODUCTION PASSAGES FOR WORKING FLUID

(75) Inventors: Hiroshi Hasegawa, Osaka (JP); Takeshi Ogata, Osaka (JP); Takumi Hikichi, Osaka (JP); Masanobu Wada, Osaka (JP); Yasufumi Takahashi, Osaka (JP)

(73) Assignee: Panasonic Corporation, Osaka (JP)

( * ) Notice: Subject to any disclaimer, the term of this patent is extended or adjusted under 35 U.S.C. 154(b) by 557 days.

(21) Appl. No.: 12/376,349

(22) PCT Filed: Sep. 21, 2007

(86) PCT No.: PCT/JP2007/068441

§ 371 (c)(1),
(2), (4) Date: Feb. 4, 2009

(87) PCT Pub. No.: WO2008/044456

PCT Pub. Date: Apr. 17, 2008

(65) Prior Publication Data

US 2010/0158729 A1 Jun. 24, 2010

(30) Foreign Application Priority Data

Oct. 11, 2006 (JP) ..... 2006-277531

(51) Int. Cl.

| | |
|---|---|
| ***F01C 1/30*** | (2006.01) |
| ***F03C 2/00*** | (2006.01) |
| ***F03C 4/00*** | (2006.01) |
| ***F04C 18/00*** | (2006.01) |

(52) U.S. Cl. ..... 418/3; 418/11; 418/15; 418/60; 418/63; 417/310

(58) Field of Classification Search ..... 418/3, 11, 418/15, 60, 63, 93, 94, 270, 88, 100; 417/410.5, 417/410.3, 310

See application file for complete search history.

(56) References Cited

U.S. PATENT DOCUMENTS

| | | | | |
|---|---|---|---|---|
| 1,623,316 | A * | 4/1927 | Kinney | 417/310 |
| 5,775,883 | A | 7/1998 | Hattori et al. | |
| 2004/0083751 | A1 | 5/2004 | Nakatani et al. | |
| 2006/0165542 | A1 * | 7/2006 | Sakitani et al. | 418/60 |
| 2007/0053782 | A1 | 3/2007 | Okamoto et al. | |
| 2007/0196227 | A1 | 8/2007 | Okamoto et al. | |
| 2008/0307797 | A1 * | 12/2008 | Okamoto | 62/257 |
| 2009/0178433 | A1 | 7/2009 | Kumakura et al. | |

FOREIGN PATENT DOCUMENTS

| | | |
|---|---|---|
| CN | 1833093 A | 9/2006 |
| DE | 25 58 606 | 7/1977 |

(Continued)

*Primary Examiner* — Theresa Trieu

(74) *Attorney, Agent, or Firm* — Hamre, Schumann, Mueller & Larson, P.C.

(57) ABSTRACT

A rotary expander includes: a cylinder (61); a piston (62) disposed inside the cylinder (61); closing members disposed with the cylinder (61) being sandwiched therebetween; and an injection passage for introducing further a working fluid in the expansion process of the working fluid. An introduction outlet (65*c*) of the injection passage leading to the working chamber (69) is provided at a position located inwardly away from the inner circumferential surface (61*b*) of the cylinder (61), on one of the closing members, in such a manner that the injection passage and the discharge passage are not communicated with each other.

12 Claims, 9 Drawing Sheets

FOREIGN PATENT DOCUMENTS

| | | | | |
|---|---|---|---|---|
| JP | 58048706 | A | * | 3/1983 |
| JP | 2004-150748 | A | | 5/2004 |
| JP | 2006-046222 | A | | 2/2006 |
| WO | 02/04814 | | | 1/2002 |
| WO | 2005/088077 | | | 9/2005 |
| WO | 2006/035935 | | | 4/2006 |

* cited by examiner

ROTARY EXPANDER WITH DISCHARGE AND INTRODUCTION PASSAGES FOR WORKING FLUID

TECHNICAL FIELD

The present invention relates to a rotary expander that can be applied to air conditioners and water heaters and can be used in a mechanical power recovery type refrigeration cycle apparatus.

BACKGROUND ART

An expander has been known as a fluid machine to be used for the purpose of recovering internal energy of the pressure drop of a refrigerant in a refrigeration cycle from a high pressure to a low pressure along with the expansion of the refrigerant. A mechanical power recovery type refrigeration cycle apparatus using a conventional expander will be described below.

FIG. 7A shows a conventional mechanical power recovery type refrigeration cycle apparatus. This refrigeration cycle apparatus includes a compressor 1, a gas cooler 2, an expander 3, an evaporator 4, a rotation motor 5, and a shaft 6 for directly coupling the compressor 1, the expander 3 and the rotation motor 5. Carbon dioxide is used as a refrigerant which is a working fluid. The refrigerant is compressed in the compressor 1 to a high temperature and high pressure state, and thereafter is cooled in the gas cooler 2. The refrigerant further is subjected to pressure drop to a low temperature and low pressure state in the expander 3, and thereafter is heated in the evaporator 4. The expander 3 recovers the internal energy of the pressure drop of the refrigerant from a high pressure to a low pressure along with the expansion thereof, converts the recovered energy into the rotation energy of the shaft 6, and uses it as a part of energy for driving the compressor 1. Thus, the power consumption of the rotation motor 5 is reduced.

In the above-mentioned mechanical power recovery type refrigeration cycle apparatus, the compressor 1 and the expander 3 are coupled directly by the shaft 6. Since the compressor 1 and the expander 3 rotate at the same rotation speed, the refrigeration cycle apparatus is subjected to a so-called constraint of constant density ratio, in which the ratio between the specific volume of the suction refrigerant in the compressor 1 and the specific volume of the suction refrigerant in the expander 3 or the ratio between the density of the suction refrigerant in the compressor 1 and the density of the suction refrigerant in the expander 3 is fixed to the ratio between their suction capacities. This constraint makes it impossible to perform optimal pressure and temperature control, which causes a problem of reduction in COP (Coefficient of Performance).

JP 2004-150748 A discloses a mechanical power recovery type refrigeration cycle apparatus in which injection is performed in order to avoid the above-mentioned constraint of constant density ratio. The configuration of the refrigeration cycle apparatus is shown in FIG. 7B. According to this configuration, at the outlet side of the gas cooler 2, the passage of a refrigerant branches into two: a suction passage 9A; and an injection passage 9B. A portion of the refrigerant flows into the suction passage 9A, passes through a pre-expansion valve 7, and is drawn into the expander 3, while the remaining portion of the refrigerant flows into the injection passage 9B, passes through an adjusting valve 8, and then is introduced into a working chamber (not shown) in the expansion process in the expander 3. For the purpose of avoiding the constraint of constant density ratio, this mechanical power recovery type refrigeration cycle apparatus controls the opening degree of the pre-expansion valve 7 and the adjusting valve 8 so as to change the specific volume of the refrigerant to be drawn into the expander 3.

JP 2006-46222 A discloses a single-stage rotary expander and a two-stage rotary expander to be used in a mechanical power recovery type refrigeration cycle apparatus in which injection is performed. The configurations of these rotary expanders are shown in FIGS. 8A and 8B. According to the single-stage rotary expander as shown in FIG. 8A, an opening degree adjustable throttle valve 13 is provided in an injection passage 12 branching off a suction passage 11, and an introduction outlet 15 of the injection passage 12 leading to a working chamber 16 is provided on the inner circumferential surface 14 of a cylinder. On the other hand, according to the two-stage rotary expander as shown in FIG. 8B, an opening degree adjustable throttle valve 23 is provided in an injection passage 22 branching off a suction passage 21, and an introduction outlet 27 of the injection passage 22 leading to a working chamber 28 is provided at a position that is tangent to the inner circumferential surface 24*a* of the first cylinder 24, on a closing member (not shown) for closing the working chamber 28 at the side of the first cylinder 24.

However, the above-mentioned conventional rotary expander, in which the introduction outlet of the injection passage is provided on the inner circumferential surface of the cylinder or at the position that is tangent to the inner circumferential surface thereof, has the following problems. As shown in FIGS. 8A and 8B, when a piston is in the vicinity of the top dead center, the injection passages 12, 22 respectively are communicated with discharge passages 17, 30 through the working chamber 16, and the working chambers 28, 29 and the communication passage 26, and the working fluid leaks from the injection passages 12, 22 into the low-pressure discharge passages 17, 30. The conventional expander cannot recover the expansion energy of the working fluid that has leaked, which causes a problem of the efficiency of the expander being degraded.

DISCLOSURE OF INVENTION

The present invention has been achieved in view of the above-mentioned problems, and it is an object of the present invention to provide an expander that prevents leakage of a working fluid from an injection passage into a discharge passage and thus achieves high efficiency.

In order to solve the above-mentioned problems, the rotary expander of the present invention includes: a cylinder having an inner circumferential surface that forms a cylindrical surface; a piston being disposed inside the cylinder to form a working chamber between the piston and the inner circumferential surface and moving along the inner circumferential surface; closing members for closing the working chamber with the cylinder being sandwiched therebetween; a suction passage for allowing a working fluid to flow into the working chamber; a shaft having an eccentric portion to which the piston is fitted and receiving a rotational force by expansion of the working fluid that has flowed into the working chamber; a discharge passage for allowing the expanded working fluid to be discharged from the working chamber; and an injection passage for introducing further the working fluid into the working chamber in an expansion process of the working fluid. In this expander, an introduction outlet of the injection passage leading to the working chamber is provided at a position on one of the closing members, and the position is located inwardly away from the inner circumferential surface of the cylinder in such a manner that the injection passage and the discharge passage are not communicated with each other.

In the rotary expander of the present invention, the working fluid that has been introduced from the injection passage into the working chamber is prevented from leaking into the low-pressure discharge passage. Accordingly, the present invention can provide a highly efficient expander.

BEST MODE FOR CARRYING OUT THE INVENTION

First Embodiment

Hereinafter, the first embodiment of the present invention will be described with reference to the accompanying drawings.

Figure 1:
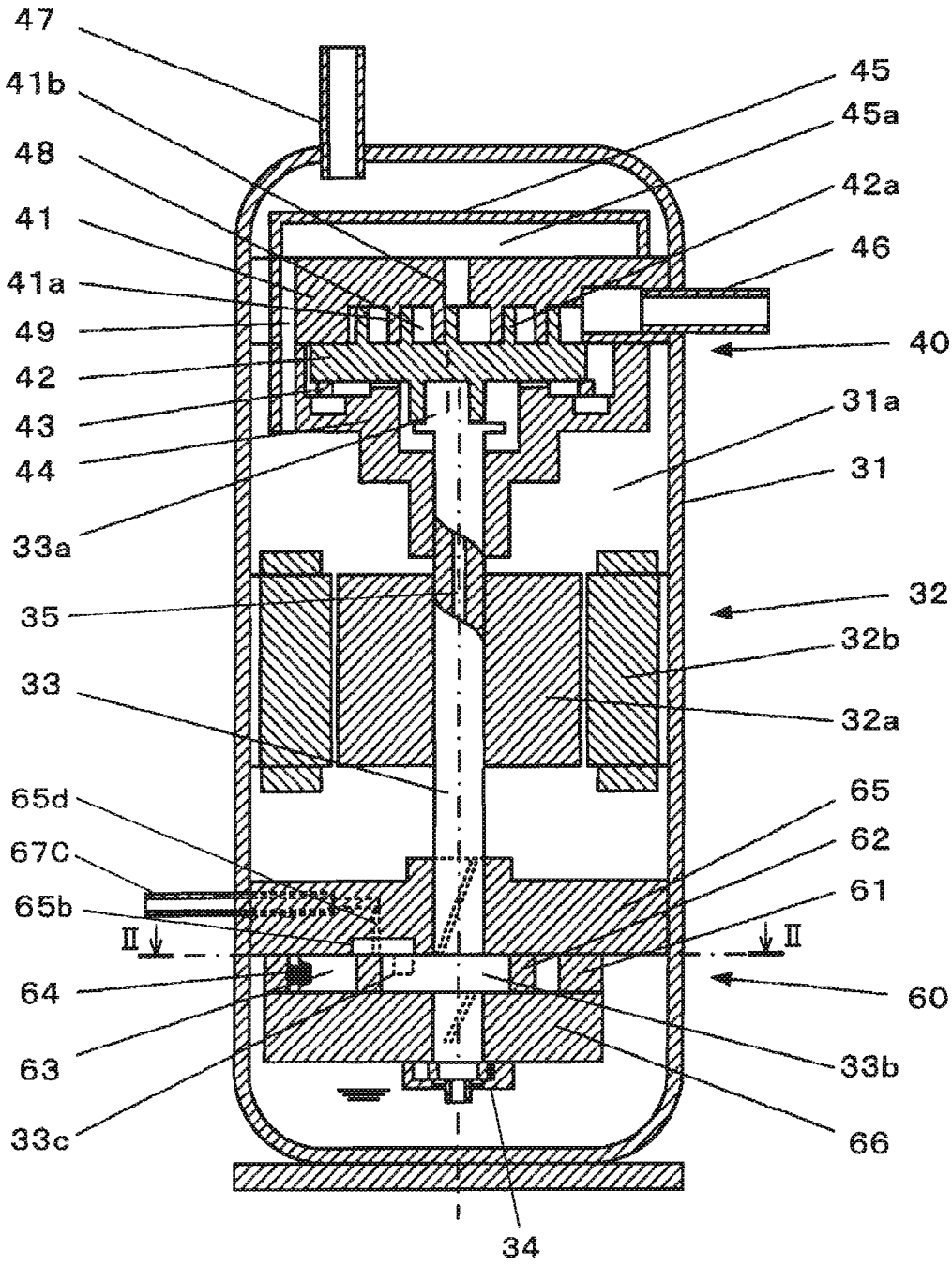
FIG. 1 is a vertical sectional view of an expander-compressor unit using a single-stage rotary expander according to a first embodiment of the present invention.
Figure 2:
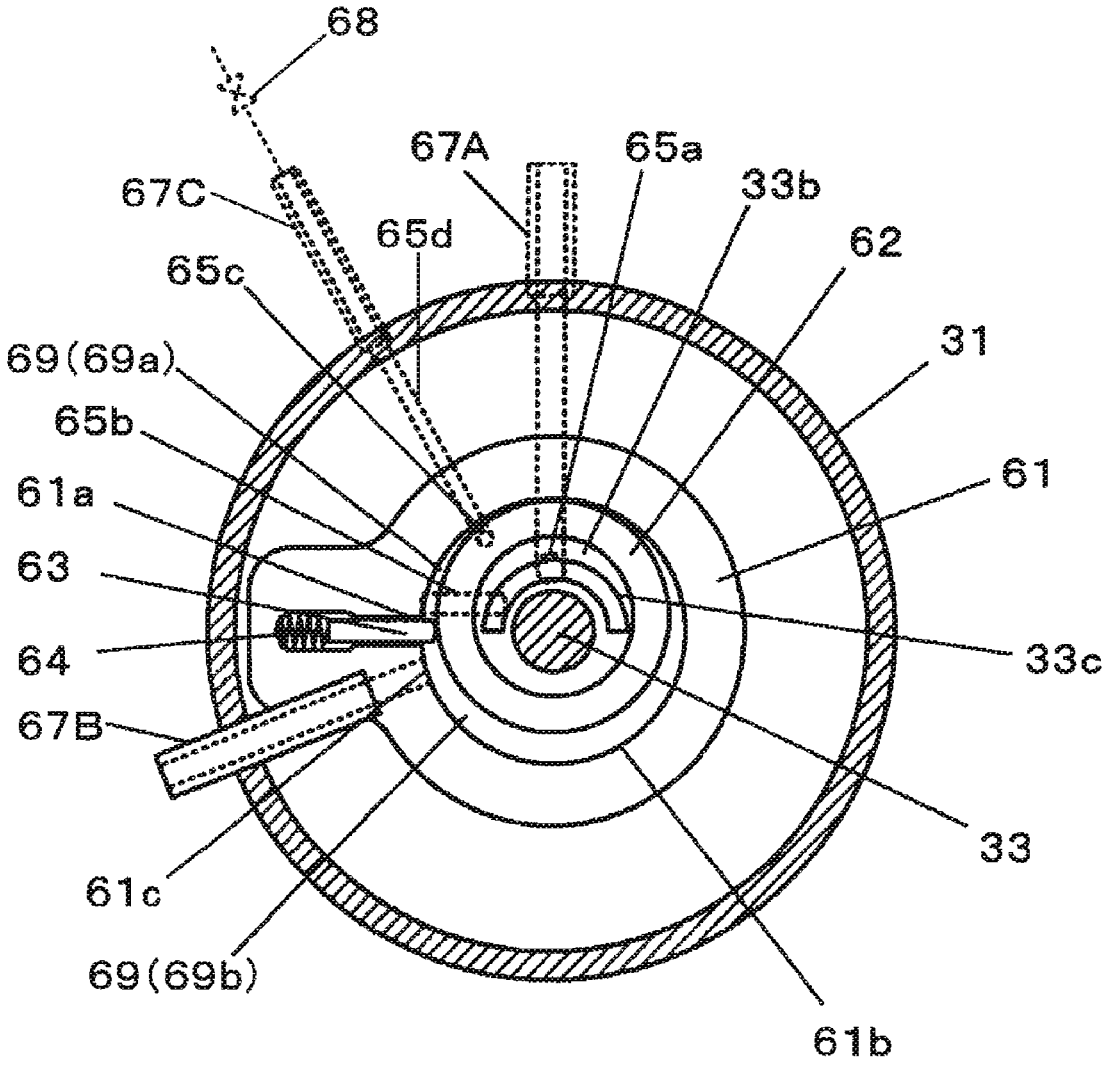
FIG. 2 is a cross sectional view taken along the line II-II of FIG. 1.

FIG. 1 is a vertical sectional view of an expander-compressor unit using a single-stage rotary expander according to the first embodiment of the present invention. FIG. 2 is a cross sectional view taken along the line II-II of FIG. 1. The expander-compressor unit includes a vertically elongated closed casing 31. In this closed casing 31, a scroll type compression mechanism 40 is disposed at the upper position, a rotary expansion mechanism 60 is disposed at the lower position, and a rotation motor 32 having a rotor 32*a* and a stator 32*b* is disposed between the compression mechanism 40 and the expansion mechanism 60. The compression mechanism 40, the expansion mechanism 60, and the rotation motor 32 are coupled to one another by a shaft 33. The expansion mechanism 60, the shaft 33, and pipes 67A to 67C to be described later constitute the single-stage rotary expander according to the first embodiment of the present invention. The compression mechanism 40 and the expansion mechanism 60 are prepared separately, and they are coupled to each other by the shaft 33 during assembly. As a working fluid to be described later, carbon dioxide is used.

Lubricating oil is stored in the bottom portion of the closed casing 31, and an oil pump 34 is provided at the lower end of the shaft 33. An oil supply passage 35 for supplying the lubricating oil to respective sliding portions of the expansion mechanism 60 and the compression mechanism 40 is formed inside the shaft 33. The shaft 33 rotates clockwise in FIG. 2. As the shaft 33 rotates, the lubricating oil is pumped up by the oil pump 34 and is supplied to the respective sliding portions through the oil supply passage 35. The lubricating oil is used for lubrication and sealing of the expansion mechanism 60 and the compression mechanism 40.

The scroll type compression mechanism 40 includes a stationary scroll 41, an orbiting scroll 42, an Oldham ring 43, a bearing member 44, a muffler 45, a suction pipe 46, and a discharge pipe 47. The orbiting scroll 42 is fitted to an eccentric portion 33*a* provided on the upper end of the shaft 33, and its self-rotation is restrained by the Oldham ring 43. The orbiting scroll 42, with its spiral lap 42*a* meshing with a lap 41*a* of the stationary scroll 41, revolves along with rotation of the shaft 33. A crescent-shaped working chamber 48 formed between the laps 41*a*, 42*a* reduces its volumetric capacity as it moves from outside to inside, and thereby, it compresses the working fluid drawn through the suction pipe 46. The compressed working fluid passes through a discharge port 41*b* formed at the center of the stationary scroll 41, an internal space 45*a* of the muffler 45, and a flow passage 49 penetrating through the stationary scroll 41 and the bearing member 44, in this order. The working fluid then is discharged to an internal space 31*a* of the closed casing 31. While the discharged working fluid is present in the internal space 31*a*, the lubricating oil mixed in the working fluid is separated from the working fluid by gravitational force and centrifugal force. Thereafter, the working fluid is discharged outside the closed casing 31 through the discharge pipe 47.

The rotary expansion mechanism 60 includes a cylinder 61, a piston 62 disposed inside the cylinder 61, an upper bearing member 65 disposed on the cylinder 61, and a lower bearing member 66 disposed beneath the cylinder 61.

A disk-like eccentric portion 33*b* is provided on the lower part of the shaft 33 in such a manner that it is off-centered from the axis of the shaft 33 by a predetermined distance. The upper bearing member 65 is fixed to the closed casing 31 and supports rotatably a portion of the shaft 33 that is above and near the eccentric portion 33*b*. The lower bearing member 66 is fixed to the upper bearing member 65 via the cylinder 61 and supports rotatably a portion of the shaft 33 that is below and near the eccentric portion 33*b*. Specifically, the upper bearing member 65 has an approximate disk-shape having a flat lower surface, and partitions the internal space of the closed casing 31 vertically. The upper bearing member 65 has, at its center, an insertion hole for accepting the shaft 33. A falling passage is provided at a suitable position on the upper bearing member 65, for allowing the oil separated from the working fluid above the upper bearing member 65 to flow down, although it is not shown in the diagram. On the other hand, the lower bearing member 66 has a plate-like shape having flat upper and lower surfaces.

The cylinder 61 has a cylindrical shape having an inner circumferential surface 61*b* that forms a cylindrical surface, an outer circumferential surface with a part thereof protruding outward, and upper and lower end surfaces parallel to each other. This cylinder 61 is located between the upper bearing member 65 and the lower bearing member 66 in such a manner that the center of the inner circumferential surface 61*b* coincides with the axis of the shaft 33. The upper end surface of the cylinder 61 is in contact with the lower surface of the upper bearing member 65, and the lower end surface thereof is in contact with the upper surface of the lower bearing member 66.

The piston 62 has a circular ring shape. The piston 62 is fitted to the eccentric portion 33*b* of the shaft 33, and thereby brought into line contact with the inner circumferential surface 61*b* of the cylinder 61 and forms the arc-shaped working chamber 69 between the piston 62 and the inner circumferential surface 61*b*. The piston 62 can rotate eccentrically inside the cylinder 61, that is, move along the inner circumferential surface 61*b* while sliding thereon. The thickness of this piston 62 is designed to be almost the same as that of the cylinder 61. The upper end surface of the piston 62 slides on the lower surface of the upper bearing member 65, and the lower end surface thereof slides on the upper surface of the lower bearing member 66. In other words, the working chamber 69 is closed by the upper bearing member 65 and the lower bearing member 66. These bearing members 65 and 66 also serve as closing members for closing the working chamber 69 with the cylinder 61 being sandwiched therebetween. The thickness of the eccentric portion 33*b* of the shaft 33 also is designed to be almost the same as that of the cylinder 61. The upper surface of the eccentric portion 33*b* slides on the lower surface of the upper bearing member 65, and the lower surface thereof slides on the upper surface of the lower bearing member 66.

The cylinder 61 has, in a position where its outer circumferential surface protrudes outward, a groove 61*a* extending radially outward from the inner circumferential surface 61*b*. In this groove 61*a*, a partition member 63 and a spring 64 are arranged. The partition member 63 is fitted in the groove 61*a* and thereby held reciprocably by the cylinder 61, and the spring 64 biases the partition member 63. The partition member 63 is biased by the spring 64, and thereby brought into contact with the piston 62. As a result, the working chamber 69 is partitioned into a suction-side working chamber 69*a* and a discharge-side working chamber 69*b*.

Next, a structure for allowing the expansion mechanism 60 to draw and discharge the working fluid will be described below.

A suction pipe 67A is connected to the upper bearing member 65, and a first passage 65*a* and a second passage 65*b* are formed on the upper bearing member 65. On the other hand, a groove portion 33*c* having a shape of a 180-degree arc is formed on the upper surface of the eccentric portion 33*b*. These first passage 65*a*, the second passage 65*b* and the groove portion 33*c* constitute a suction passage for allowing the working fluid to flow into the suction-side working chamber 69*a*. Specifically, a high-pressure working fluid flows into the groove portion 33*c* through the suction pipe 67A and the first passage 65*a*, and thereafter flows into the suction-side working chamber 69*a* through the second passage 65*b*. The first passage 65*a*, the groove portion 33*c* and the second passage 65*b* constitute an inflow timing mechanism. In this mechanism, as the groove portion 33*c* rotates along with the shaft 33, the working fluid flows into the suction-side working chamber 69*a* only while the groove portion 33*c* is in communication with both the first passage 65*a* and the second passage 65*b*. More specifically, the opening of the first passage 65*a* is positioned at 90 degrees about the axis of the shaft 33 from the partition member 63 on the lower surface of the upper bearing member 65. The second passage 65*b* formed on the lower surface of the upper bearing member 65 has a groove shape extending in the reciprocating direction of the partition member 63 in the vicinity thereof. The groove portion 33*c* is bilaterally symmetrical about a direction in which the eccentric portion 33*c* is eccentric from the axis of the shaft 33.

A discharge pipe 67B is connected to the cylinder 61, and a discharge port 61*c* is formed on the cylinder 61. The discharge pipe 67B and the discharge port 61*c* constitute a discharge passage for allowing the working fluid to flow out of the discharge-side working chamber 69*b*. The opening of the discharge port 61*c* is formed in the vicinity of the partition member 63 on the inner circumferential surface 61*b* of the cylinder 61.

Figure 3:
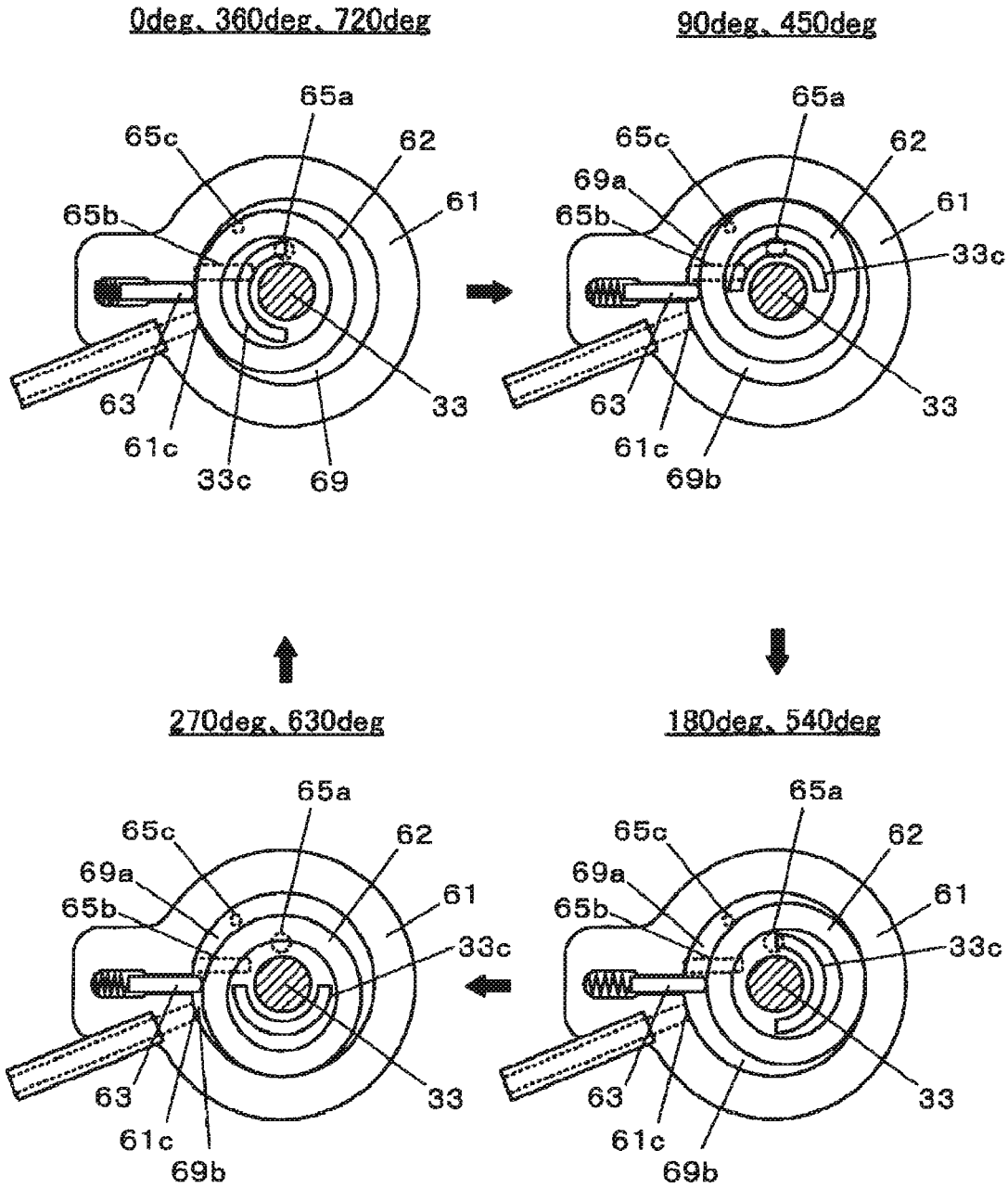
FIG. 3 is a diagram illustrating the operating principle of the expansion mechanism of FIG. 1.

FIG. 3 is a diagram illustrating the operating principle of the expansion mechanism 60 at every 90 degrees of the rotational angle of the shaft 33. At an angle of 0 degree (where the contact point between the piston 62 and the inner circumferential surface 61*b* of the cylinder 61 is located on the partition member 63), the groove portion 33*c* is communicated with the first passage 65*a* and the second passage 65*b* at the same time and a suction process starts, in which a high-pressure working fluid flows into the suction-side working chamber 69*a*. At an angle of slightly more than 90 degrees, the communication between the groove portion 33*c* and the second passage 65*b* is cut, and the suction process is completed. Thereafter, the working fluid in the suction-side working chamber 69*a* expands while being decompressed, and the volumetric capacity of the suction-side working chamber 69*a* increases as the rotational angle increases to 180 and 270 degrees. At that time, the shaft 33 receives a rotational force by the expansion of the working fluid. Immediately before the shaft 33 goes into a 360-degree roll, the suction-side working chamber 69*a* is communicated with the discharge port 61*c*, and the expansion process is completed. Thereafter, when the contact point between the piston 62 and the inner circumferential surface 61*b* of the cylinder 61 passes the partition member 63 at an angle of 360 degrees, the current suction-side working chamber shifts to the discharge-side working chamber 69*b*, and a new suction-side working chamber 69*a* is formed between the contact point and the partition member 63. Thereafter, during a period until the rotational angle reaches 720 degrees, the expanded working fluid flows out through the discharge port 61*c* as the volumetric capacity of the discharge-side working chamber 69*b* decreases. Thus, a discharge process is performed.

In the first embodiment, as shown in FIGS. 1 and 2, an injection pipe 67C is connected to the upper bearing member 65, and an injection port 65*d* is formed on the upper bearing member 65. The injection pipe 67C and the injection port 65*d* constitute an injection passage for further introducing the working fluid into the suction-side working chamber 69*a* during the expansion process of the working fluid (while the working fluid is still expanding). A working fluid supply pipe (not shown in the diagram) branches into the injection pipe 67C and the suction pipe 67A. The injection pipe 67C is provided with an opening degree adjustable throttle valve 68. The injection port 65*d* is provided with a check valve, although it is not shown in the diagram.

The opening of the injection port 65*d*, that is, the introduction outlet 65*c* of the injection passage leading to the suction-side working chamber 69*a* is provided at a position located inwardly away from (offset from) the inner circumferential surface 61*b* of the cylinder 61, on the lower surface of the upper bearing member 65. More specifically, the introduction outlet 65*c* is positioned at approximately 55 degrees about the axis of the shaft 33 from the partition member 63. Therefore, the injection passage can open only into the suction-side working chamber 69*a* by the opening and closing of the introduction outlet 65*c* by the movement of the piston 62. This prevents the injection passage and the discharge passage from being communicated with each other.

Figure 7A:
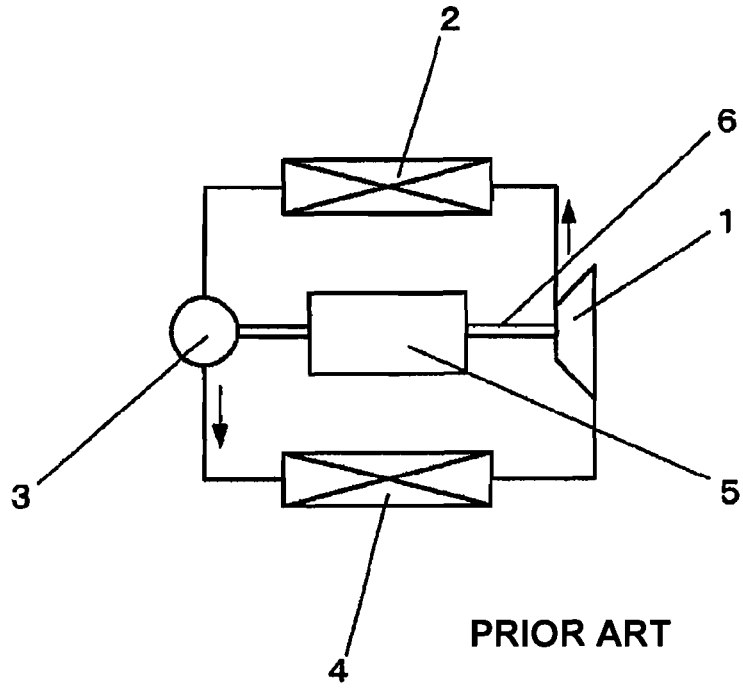
FIG. 7A is a diagram showing a conventional mechanical power recovery type refrigeration cycle apparatus.
Figure 7B:
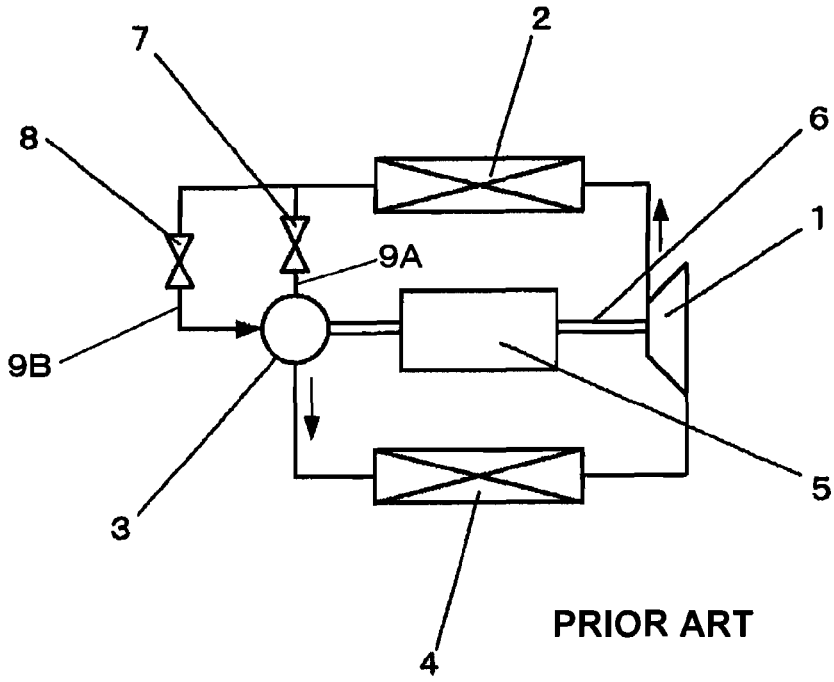
FIG. 7B is a diagram showing a conventional mechanical power recovery type refrigeration cycle apparatus in which injection is performed.
Figure 8A:
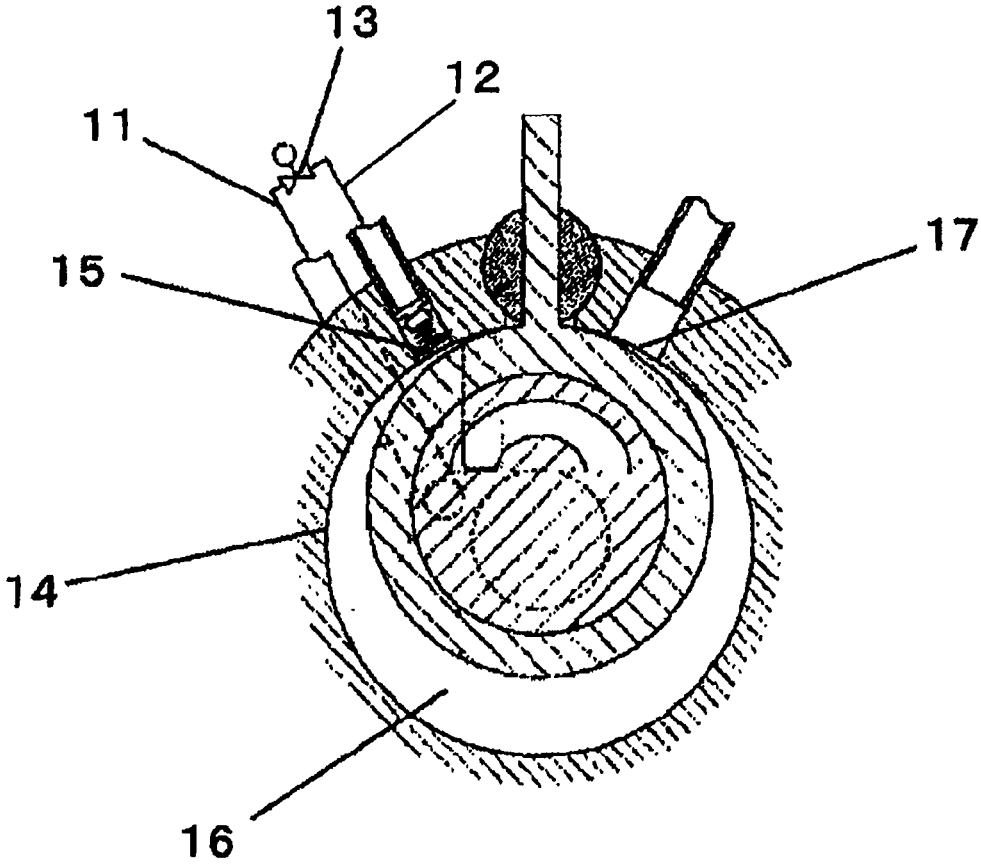
PRIOR ART FIG.8A
FIG. 8A is a cross sectional view of a conventional single-stage rotary expander.
Figure 8B:
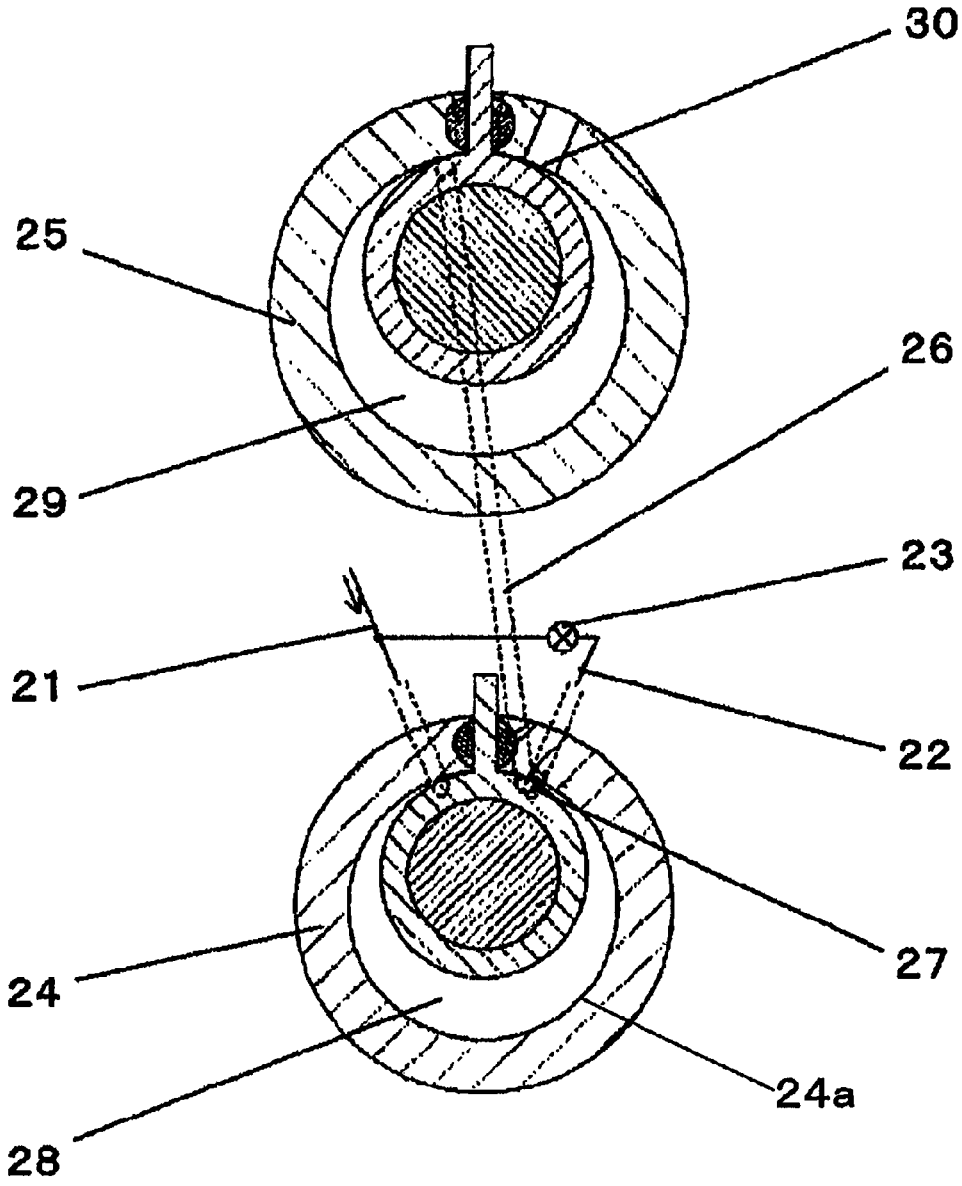
PRIOR ART FIG.8B
FIG. 8B is a cross sectional view of a conventional two-stage rotary expander.

Specifically, as shown in FIG. 3, the introduction outlet 65*c* is closed completely by the upper end surface of the piston 62 immediately before the contact point between the piston 62 and the inner circumferential surface 61*b* of the cylinder 61 reaches the discharge port 61*c* (that is, when the contact point reaches the vicinity of the discharge port 61*c*). The introduction outlet 65*c* is opened gradually after the contact point between the piston 62 and the inner circumferential surface 61*b* rotates approximately 90 degrees from the partition member 63. As described above, the introduction outlet 65*c* is closed by the upper end surface of the piston 62 at least during a period from the start of the discharge process to the end thereof, and is opened from the last moment of the suction process throughout the expansion process. Also in the present embodiment, the injection passage allows the working fluid to flow into the suction-side working chamber 69*a* through a control valve 8 (throttle valve 68), as in the case of FIG. 7B. In the present embodiment, however, the introduction outlet 65*c* is closed by the piston 62 at least during the discharge process, which prevents the working fluid, which has flowed into the suction-side working chamber 69*a* through the injection port 65*d*, from leaking directly to the low-pressure discharge port 61*c*.

Accordingly, the present embodiment makes it possible to recover the expansion energy, which cannot be recovered in the conventional expander due to the leakage of the working fluid, and thus provides a highly efficient expander. As a result, the efficiency of the mechanical power recovery type refrigeration cycle using the expander-compressor unit can be improved.

It should be noted that if the introduction outlet 65*c* is provided at a position slightly shifted in the rotational direction of the shaft 33 from the position as shown in FIG. 3, the introduction outlet 65*c* can be opened after the working fluid flows completely from the suction passage into the suction-side working chamber 69*a*. In this case, it is possible to prevent the outflow of the high-pressure working fluid into a dead space in the injection port 65*d* (a space between the introduction outlet 65*c* and the check valve).

The introduction outlet 65*c* does not necessarily need to be provided at the position shown in the present embodiment, but the position of the introduction outlet 65*c* should be within a range of angles from the partition member 63 to 90 degrees in the rotational direction of the shaft 33. When the introduction outlet 65*c* is provided at such a position, it is possible to allow the introduction outlet 65*c* to open for a relatively long period of time in the expansion process. More preferably, the introduction outlet 65*c* is positioned at an angle ranging from 30 to 70 degrees inclusive from the partition member 63 in the rotational direction of the shaft 33. Furthermore, it is also possible to provide the injection port 65*d* in the lower bearing member 66 and to provide the introduction outlet 65*c* of the injection passage at a position located inwardly away from the inner circumferential surface 61*b* of the cylinder 61, on the upper surface of the lower bearing member 66.

Second Embodiment

Hereinafter, the second embodiment of the present invention will be described with reference to the accompanying drawings.

Figure 4:
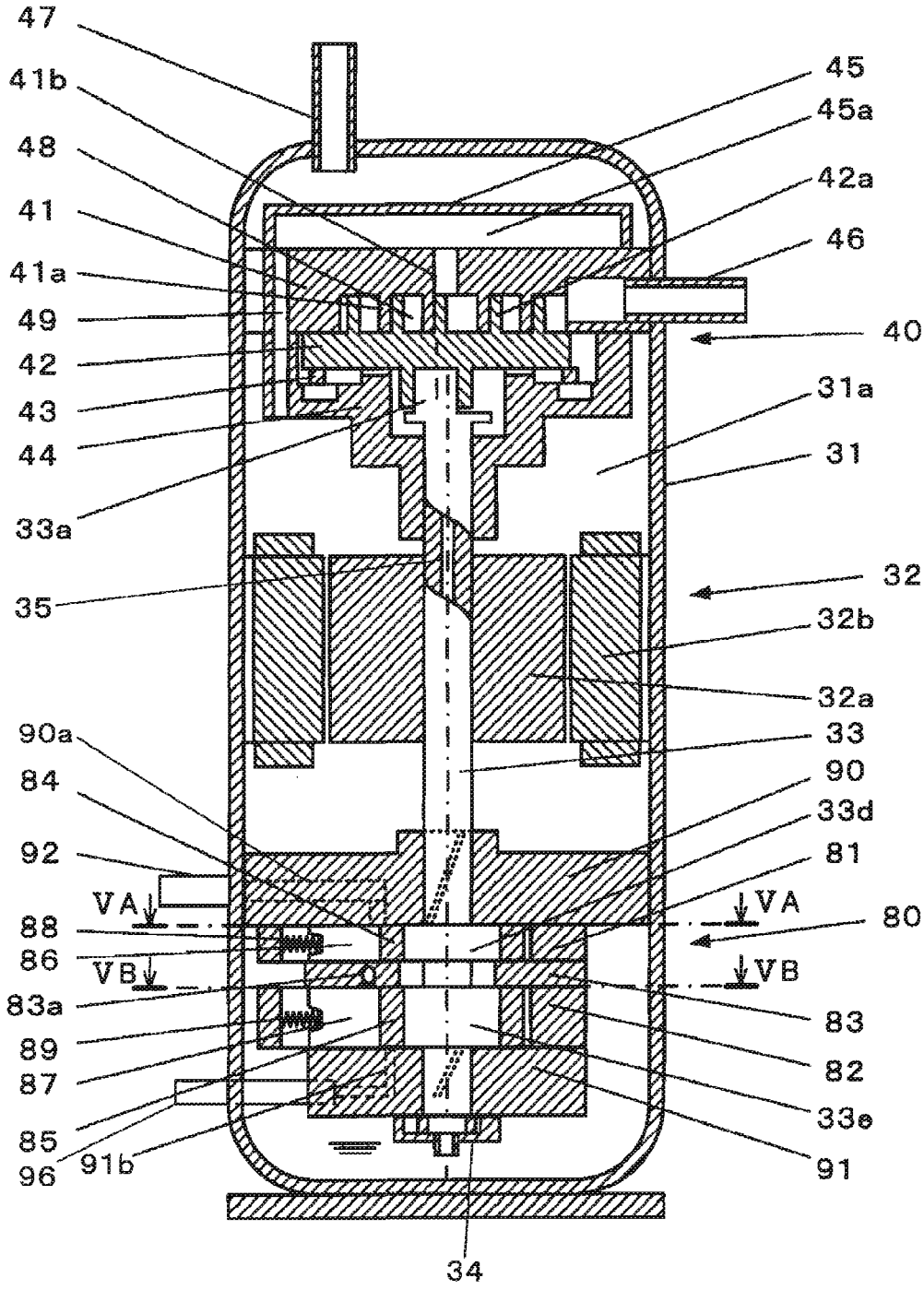
FIG. 4 is a vertical sectional view of an expander-compressor unit using a two-stage rotary expander according to a second embodiment of the present invention.
Figure 5A:
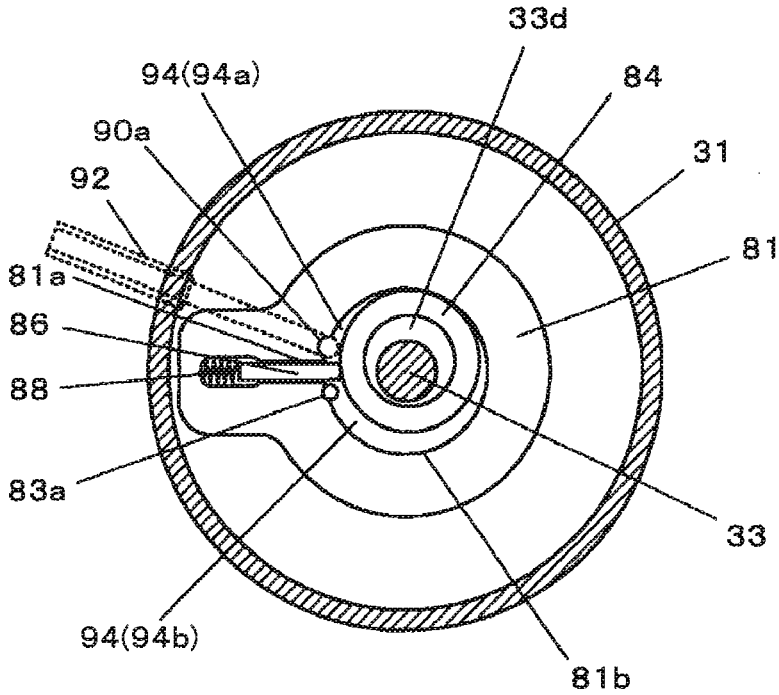
FIG. 5A is a cross sectional view taken along the line VA-VA of FIG. 4.
Figure 5B:
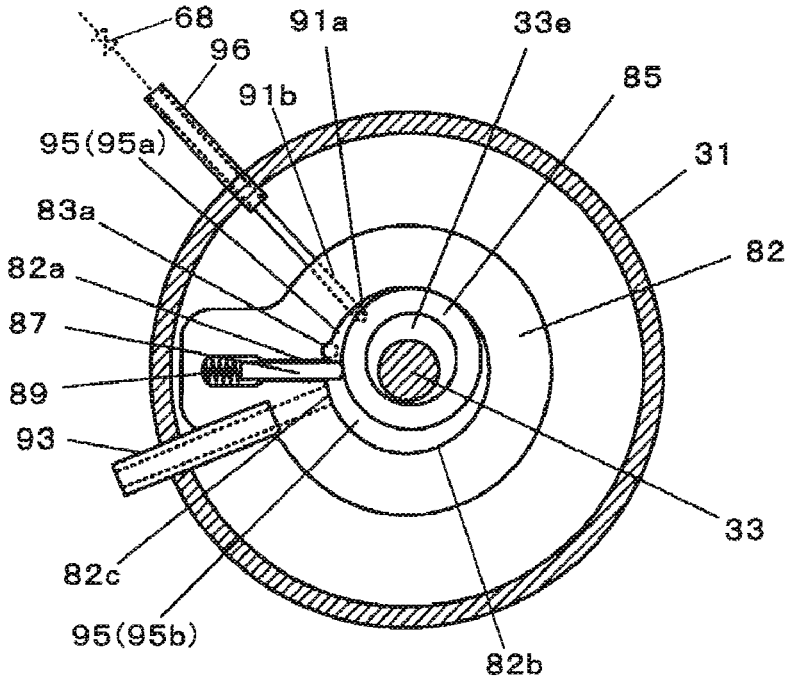
FIG. 5B is a cross sectional view taken along the line VB-VB of FIG. 4.

FIG. 4 is a vertical sectional view of an expander-compressor unit using a two-stage rotary expander according to the second embodiment of the present invention. FIG. 5A is a cross sectional view taken along the line VA-VA of FIG. 4. FIG. 5B is a cross sectional view taken along the line VB-VB of FIG. 4. The expander-compressor unit of the second embodiment has the same configuration as that of the expander-compressor unit of the first embodiment except that the expansion mechanism is a two-stage rotary type. Therefore, the same parts are designated by the same numerals and the description thereof is not repeated.

A two-stage rotary expander 80 includes: a first cylinder 81 and a second cylinder 82 arranged vertically; a first piston 84 disposed inside the first cylinder 81; a second piston 85 disposed inside the second cylinder 82; an intermediate plate 83 disposed between the first cylinder 81 and the second cylinder 82; an upper bearing member 90 disposed on the first cylinder 81; and a lower bearing member 91 disposed beneath the second cylinder 82.

A disk-like first eccentric portion 33*d* and second eccentric portion 33*e* are provided on the lower part of the shaft 33 in such a manner that they are off-centered from the axis of the shaft 33 by a predetermined distance in the same direction. The upper bearing member 90 is fixed to the closed casing 31 and supports rotatably a portion of the shaft 33 that is above and near the first eccentric portion 33*d*. The lower bearing member 91 is fixed to the upper bearing member 90 via the first cylinder 81, the intermediate plate 83 and the second cylinder 82, and supports rotatably a portion of the shaft 33 that is below and near the second eccentric portion 33*b*. Specifically, the upper bearing member 90 has an approximately disk-like shape with a flat lower surface, and partitions the inside space of the closed casing 31 vertically. The upper bearing 90 has, at its center, an insertion hole for inserting the shaft 33. A falling passage is provided at a suitable position on the upper bearing 90, for allowing the oil separated from the working fluid above the upper bearing member 90 to flow down, although it is not shown in the diagram. On the other hand, the lower bearing 91 has a plate-like shape having flat upper and lower surfaces. The intermediate plate 83 has a plate-like shape having flat upper and lower surfaces. The thickness of the intermediate plate 83 is designed to be almost the same as the distance between the first eccentric portion 33*d* and the second eccentric portion 33*e*. The intermediate plate 83 has, at its center, a through-hole for allowing the second eccentric portion 33*e* to pass through during assembly.

The first cylinder 81 and the second cylinder 82 have a cylindrical shape respectively having inner circumferential surfaces 81*b*, 82*b* forming cylindrical surfaces, outer circumferential surfaces each with a part thereof protruding outward, and upper and lower end surfaces parallel to each other. The thickness of the second cylinder 82 is designed to be greater than that of the first cylinder 81. The first cylinder 81 is located between the upper bearing member 90 and the intermediate plate 83 in such a manner that the center of the inner circumferential surface 81*b* coincides with the axis of the shaft 33. The upper end surface of the first cylinder 81 is in contact with the lower surface of the upper bearing member 90, and the lower end surface thereof is in contact with the upper surface of the intermediate plate 83. The second cylinder 82 is located between the intermediate plate 83 and the lower bearing member 91 in such a manner that the center of the inner circumferential surface 82*b* coincides with the axis of the shaft 33. The upper end surface of the second cylinder 82 is in contact with the lower surface of the intermediate plate 83, and the lower end surface thereof is in contact with the upper surface of the lower bearing member 91.

The first piston 84 and the second piston 85 each have a circular ring shape. The first piston 84 and the second piston 85 are fitted to the eccentric portions 33*d*, 33*e* of the shaft 33, and thereby brought into line contact with the inner circumferential surface 81*b* of the first cylinder 81 and the inner circumferential surface 82*b* of the second cylinder 82 to form arc-shaped working chambers 94, 95 between the first piston 84 and the inner circumferential surface 81*b* and between the second piston 85 and the inner circumferential surface 82*b*, respectively. The first and second pistons 84, 85 can rotate eccentrically inside the cylinders 81, 82, that is, move along the inner circumferential surfaces 81*b*, 82*b* respectively, while sliding thereon. The thicknesses of the pistons 84, 85 are designed to be almost the same as those of the cylinders 81, 82. The upper end surfaces of the pistons 84, 85 slide on the lower surfaces of the upper bearing member 90 and the intermediate plate 83, and the lower end surfaces of the pistons 84, 85 slide on the upper surfaces of the intermediate plate 83 and the lower bearing member 91. In other words, the working chamber 94 at the side of the first cylinder 81 is closed by the upper bearing member 90 and the intermediate plate 83. The working chamber 95 at the side of the second cylinder 82 is closed by the intermediate plate 83 and the lower bearing member 91. The bearing member 90 and the intermediate plate 83 as well as the bearing member 91 and the intermediate plate 83, respectively, also serve as closing members for closing the working chambers 94, 95 with the cylinders 81, 82 being sandwiched therebetween. The thicknesses of the eccentric portions 33*d*, 33*e* of the shaft 33 also are designed to be almost the same as those of the cylinders 81, 82. The upper surfaces of the eccentric portions 33*d*, 33*e* slide on the lower surfaces of the upper bearing member 90 and the intermediate plate 83, and the lower surfaces of the eccentric portions 33*d*, 33*e* slide on the upper surfaces of the intermediate plate 83 and the lower bearing member 91.

In the present embodiment, the inner circumferential surface 81*b* of the first cylinder 81 has the same diameter as that of the inner circumferential surface 82*b* of the second cylinder 82, and the first piston 84 has the same outer diameter as that of the second piston 85. Furthermore, the second cylinder 82 has a greater thickness than that of the first cylinder 81. Thereby, the working chamber 95 at the side of the second cylinder 82 has a greater volumetric capacity than that of the working chamber 94 at the side of the first cylinder 81. However, the diameter of the inner circumferential surface 82*b* of the second cylinder 82 may be designed to be greater than that of the inner circumferential surface 81*b* of the first cylinder 81, or the outer diameter of the second piston 85 may be designed to be smaller than that of the first piston 84, while both the first cylinder 81 and the second cylinder 82 have the same thickness.

The first cylinder 81 and the second cylinder 82 respectively have, in positions where their outer circumferential surfaces protrude outward, grooves 81*a*, 82*a* extending radially outward from the inner circumferential surfaces 81*b*, 82*b*. In these grooves 81*a*, 82*a*, a first partition member 86 and a second partition member 87 as well as springs 88, 89 for biasing these partition members 86, 87 are arranged respectively. The first and second partition members 86, 87 are fitted in the grooves 81*a*, 82*a* respectively and thereby held reciprocably by the cylinders 81, 82. The partition members 86, 87 are biased by the springs 88, 89, and thereby brought into contact with the pistons 84, 85. As a result, the working chamber 94 is partitioned into a suction-side working chamber 94*a* and a discharge-side working chamber 94*b*, and the working chamber 95 is partitioned into a suction-side working chamber 95*a* and a discharge-side working chamber 95*b*. A communication passage 83*a* is provided in the intermediate plate (intermediate closing member) 83. The communication passage 83*a* communicates an area in the vicinity of the first partition member 86 in the discharge-side working chamber 94*b* at the side of the first cylinder 81 with an area in the vicinity of the second partition member 87 in the suction-side working chamber 95*a* at the side of the second cylinder 82. These discharge-side working chamber 94*b*, the communication passage 83*a*, and the suction-side working chamber 95*a* constitute an expansion chamber.

Next, a structure for allowing the expansion mechanism 80 to draw and discharge the working fluid will be described below.

A suction pipe 92 is connected to the upper bearing member 90, and a suction port 90*a* is formed on the upper bearing member 90. The suction pipe 92 and the suction port 90*a* constitute a suction passage for allowing the working fluid to flow into the discharge-side working chamber 94*a*. The opening of the suction port 90*a* is provided at a position in the vicinity of the first partition member 86 on the lower surface of the upper bearing member 90.

A discharge pipe 93 is connected to the second cylinder 82, and a discharge port 82*c* is formed on the second cylinder 82. The discharge pipe 93 and the discharge port 82*c* constitute a discharge passage for allowing the working fluid to flow out of the discharge-side working chamber 95*b*. The opening of the discharge port 82*c* is provided at a position in the vicinity of the second partition member 87 on the inner circumferential surface 82*b* of the second cylinder 82.

Figure 6:
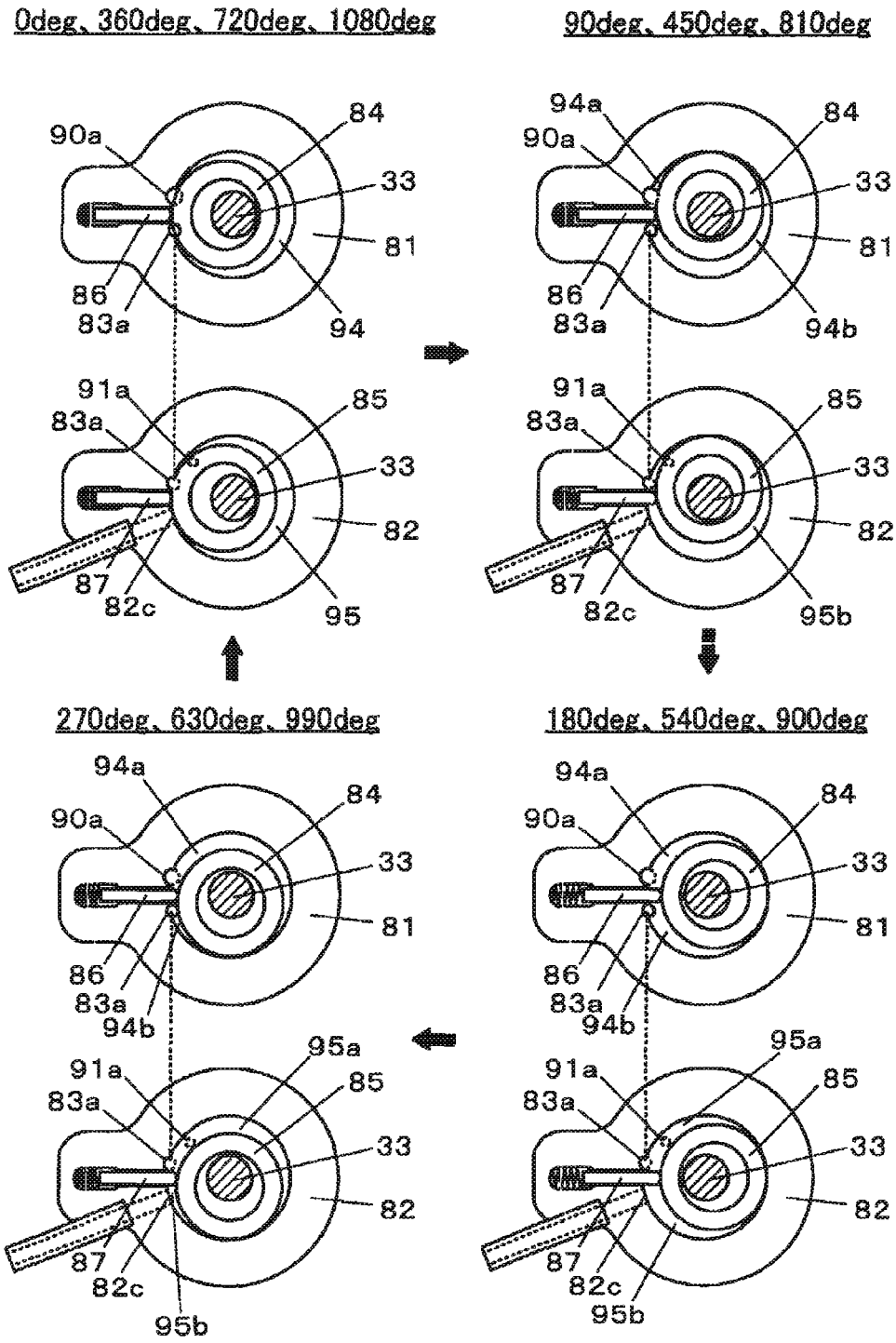
FIG. 6 is a diagram illustrating the operating principle of the expansion mechanism of FIG. 4.

FIG. 6 is a diagram illustrating the operating principle of the expansion mechanism 80 at every 90 degrees of the rotational angle of the shaft 33. At an angle of 0 degree (where the contact point between the first piston 84 and the inner circumferential surface 81*b* of the first cylinder 81 is located on the first partition member 86), a suction process starts, and the working fluid flows into the suction-side working chamber 94*a* through the suction port 90*a* of the first cylinder 81. When the rotational angle of the shaft 33 reaches 360 degrees, the suction process is completed. Thereafter, when the contact point between the first piston 84 and the inner circumferential surface 81*b* of the first cylinder 81 passes the first partition member 86 at the angle of 360 degrees, the current suction-side working chamber shifts to the discharge-side working chamber 94*b*, and a new suction-side working chamber 94*a* is formed between the contact point and the first partition member 86. Thus, an expansion process, in which the working fluid expands while moving from the discharge-side working chamber 94*b* to the suction-side working chamber 95*a* at the side of the second cylinder 82 through the communication hole 83*a*, is started. When the rotational angle of the shaft 33 reaches 720 degrees, the discharge-side working chamber 94*b* at the side of the first cylinder 81 disappears, and the expansion process is completed. During this process, the shaft 33 receives a rotational force by the expansion of the working fluid. When the contact point between the second piston 85 and the inner circumferential surface 82*b* of the second cylinder 82 passes the second partition member 87 at the angle of 720 degrees, the current suction-side working chamber at the side of the second cylinder 82 shifts to the discharge-side working chamber 95*b*, and a new suction-side working chamber 95*a* is formed between the contact point and the second partition member 87. Thereafter, during a period until the angle reaches 1080 degrees, the expanded working fluid flows out through the discharge port 82*c* as the volumetric capacity of the discharge-side working chamber 95*b* decreases. Thus, a discharge process is performed.

In the second embodiment, an injection pipe 96 is connected to the lower bearing member 91, and an injection port 91*b* is formed on the lower bearing member 91. The injection pipe 96 and the injection port 91*b* constitute an injection passage for further introducing the working fluid into the suction-side working chamber 95*a* at the side of the second cylinder 82 during the expansion process of the working fluid. A working fluid supply pipe (not shown) branches into the injection pipe 96 and the suction pipe 92. The injection pipe 96 is provided with an opening degree adjustable throttle valve 68. The injection port 91*b* is provided with a check valve, although it is not shown in the diagram.

The opening of the injection port 91*b*, that is, an introduction outlet 91*a* of the injection passage leading to the suction-side working chamber 95*a* is provided at a position located inwardly away from (offset from) the inner circumferential surface 82*b* of the second cylinder 82, on the upper surface of the lower bearing member 91. More specifically, the introduction outlet 91*a* is positioned at approximately 50 degrees about the axis of the shaft 33 from the second partition member 87. Therefore, the injection passage can open only into the suction-side working chamber 95*a* by the opening and closing of the introduction outlet 91*a* by the movement of the second piston 85. This prevents the injection passage and the discharge passage from being communicated with each other.

Specifically, as shown in FIG. 6, the introduction outlet 91*a* is closed completely by the lower end surface of the second piston 85 immediately before the contact point between the second piston 85 and the inner circumferential surface 82*b* of the second cylinder 82 reaches the discharge port 82*c* (that is, when the contact point reaches the vicinity of the discharge port 82*c*). The introduction outlet 91*a* is opened gradually after the contact point between the second piston 85 and the inner circumferential surface 82*b* rotates approximately 90 degrees from the second partition member 87. Thus, the introduction outlet 91*a* is closed by the lower end surface of the second piston 85 at least from the start of the discharge process to the end thereof, and is opened from soon after the start of the expansion process to the last moment thereof. Also in the present embodiment, the injection passage allows the working fluid to flow into the suction-side working chamber 95*a* at the side of the second cylinder 82 through a control valve 8 (throttle valve 68), as in the case of FIG. 7B. In the present embodiment, however, the introduction outlet 91*a* is closed by the second piston 85 at least during the discharge process, which prevents the working fluid, which has flowed into the suction-side working chamber 95*a* through the injection port 91*b*, from leaking directly to the low-pressure discharge port 82*c*.

Accordingly, the present embodiment makes it possible to recover the expansion energy of the working fluid which leaks from the injection port 91*b* to the discharge port 82*c* and cannot be recovered in the conventional expander, and thus provide a highly efficient expander. As a result, the efficiency of the mechanical power recovery type refrigeration cycle using the expander-compressor unit can be improved.

The introduction outlet 91*a* does not necessarily need to be provided at the position shown in the present embodiment. The position of the introduction outlet 91*a* should be within a range of angles from the second partition member 87 to 90 degrees in the rotational direction of the shaft 33. When the introduction outlet 91*a* is provided at such a position, it is possible to allow the introduction outlet 91*a* to open for a relatively long period of time in the expansion process. More preferably, the introduction outlet 91*a* is positioned at an angle ranging from 30 to 70 degrees inclusive from the second partition member 87 in the rotational direction of the shaft 33.

In order not to communicate between the injection passage and the discharge passage, the introduction outlet 91*a* should be provided at a position that allows the injection passage to open only into the expansion chamber by the opening and closing of the introduction outlet 91*a* by the movement of the second piston 85 or the first piston 84. For example, the injection port 91*b* may be provided in the upper closing member 90. In this case, the introduction outlet 91*a* is provided at a position within a range of angles from the first partition member 86 to ±90 degrees in the rotational direction of the shaft 33, on the lower surface of the upper closing member 90 in such a manner that the upper end surface of the first piston 84 opens and closes the introduction outlet 91*a*. If the injection port 91*b* is provided on the lower bearing member 91, as in the present embodiment, the working fluid can be introduced therethrough in the latter part of the expansion process. Since the pressure in the suction-side working chamber 95*a* at the side of the second cylinder 82 is lower than that in the discharge-side working chamber 94*b* at the side of the first cylinder 81, the introduction outlet 91*a* provided on the lower bearing member 91 can introduce more working fluid into the expansion chamber than the introduction outlet 91*a* provided in the upper bearing member 90. Accordingly, the two-stage rotary expander according to the present embodiment makes it possible to widen the variable range of the density ratio by ensuring a wide adjustable range of the injection amount, and thus to perform optimal pressure and temperature control at a wide range of environmental temperatures.

Furthermore, it is also possible to provide the injection port 91*b* in the intermediate plate 83 and provide the introduction outlet 91*a* on the upper or lower surface of the intermediate plate 83. However, it is more preferable to provide the injection port 91*b* and the introduction outlet 91*a* as in the present embodiment in order to make the thickness of the intermediate plate 83 small.

Additional Comments

As described above, when a valve that cannot perform control in synchronism with the rotational period of the shaft 33, for example, the throttle valve 68 for only adjusting the opening degree for controlling the flow rate of the working fluid, is used as the adjusting valve 8, the opening degree of the adjusting valve 8 is kept constant, and the working fluid cannot be prevented from leaking from the injection ports 65*d*, 91*b* into the discharge ports 61*c*, 82*c*, respectively. However, the rotary expander of the present invention produces a remarkable effect of preventing the leakage of the working fluid. When the adjusting valve 8 is a solenoid valve that can control the opening and closing in synchronism with the rotational period of the shaft 33, it is possible to intensify doubly the advantageous effect of the present invention, that is, the prevention of leakage of the working fluid from the injection ports 65*d* and 91*b* into the discharge ports 61*c* and 82*c* by controlling the adjusting valve 8 so that it is opened during the suction process or the expansion process and closed immediately before the start of the discharge process.

The present invention is mainly intended to be applied to an expander of an expander-compressor unit in which injection is performed in order to avoid the constraint of constant density ratio. It is needless to say, however, that the present invention also can be applied to an expander as a single unit separated from a compressor.

The first and second embodiments have described the rotary piston type expansion mechanisms 60 and 80 as examples. It is needless to say, however, that the same advantageous effects can be obtained also when such a rotary piston type expansion mechanism is replaced by a single-stage or two-stage swing piston type expansion mechanism in which a partition member and a piston are integrated.

INDUSTRIAL APPLICABILITY

The expander of the present invention is useful as a mechanical power recovery means for recovering expansion energy of a working fluid in a refrigeration cycle.

The invention claimed is:

1. A rotary expander comprising:

a cylinder having an inner circumferential surface that forms a cylindrical surface;

a piston disposed inside the cylinder to form a working chamber between the piston and the inner circumferential surface, the piston moving along the inner circumferential surface;

closing members for closing the working chamber with the cylinder being sandwiched therebetween;

a suction passage for allowing a working fluid to flow into the working chamber;

a shaft having an eccentric portion to which the piston is fitted, the shaft receiving a rotational force by expansion of the working fluid that has flowed into the working chamber;

a discharge passage for allowing the expanded working fluid to be discharged from the working chamber; and a partition member for partitioning the working chamber into a suction-side working chamber and a discharge-side working chamber, the partition member being held by the cylinder, an injection passage for introducing further the working fluid into the working chamber in an expansion process of the working fluid, wherein an introduction outlet of the injection passage leading to the working chamber is provided at a position on one of the closing members, the position being located inwardly away from the inner circumferential surface of the cylinder in such a manner that the injection passage and the discharge passage are not in communication with each other and the introduction outlet is provided at a position that allows the injection passage to open only into the suction-side working chamber by opening and closing of the introduction outlet by the movement of the piston.

2. The rotary expander according to claim 1, wherein the position of the introduction outlet is within a range of angles from the partition member to 90 degrees in a direction of the rotation of the shaft.

3. The rotary expander according to claim 1, wherein the introduction outlet is provided at a position that allows the introduction outlet to open after the working fluid flows completely from the suction passage into the suction-side working chamber.

4. The rotary expander according to claim 1, wherein the shaft is coupled to a compression mechanism for compressing the working fluid.

5. The rotary expander according to claim 1, wherein the working fluid is carbon dioxide.

6. The rotary expander according to claim 1, wherein the introduction outlet is closed completely by the upper or lower end surface of the piston immediately before the contact point between the piston and the inner circumferential surface of the cylinder reaches a discharge port of the discharge passage, and the introduction outlet is closed by the upper or lower end surface of the piston at least during a period from the start of the discharge process to the end thereof.

7. A rotary expander comprising:

a first cylinder having an inner circumferential surface that forms a cylindrical surface;

a second cylinder having an inner circumferential surface that forms a cylindrical surface;

a first piston disposed inside the first cylinder to form a working chamber between the first piston and the inner circumferential surface, the first piston moving along the inner circumferential surface of the first cylinder;

a second piston disposed inside the second cylinder to form a working chamber between the second piston and the inner circumferential surface, the second piston moving along the inner circumferential surface of the second cylinder;

an intermediate closing member disposed between the first cylinder and the second cylinder;

a first closing member disposed at an opposite side of the intermediate closing member across the first cylinder;

a second closing member disposed at an opposite side of the intermediate closing member across the second cylinder;

a suction passage for allowing a working fluid to flow into the working chamber at a side of the first cylinder;

a shaft having eccentric portions to which the first and second pistons are fitted, the shaft receiving a rotational force by expansion of the working fluid;

a discharge passage for allowing the expanded working fluid to be discharged from the working chamber at a side of the second cylinder;

a first partition member for partitioning the working chamber at the side of the first cylinder into a suction-side working chamber and a discharge-side working chamber, the first partition member being held by the first cylinder;

a second partition member for partitioning the working chamber at the side of the second cylinder into a suction-side working chamber and a discharge-side working chamber, the second partition member being held by the second cylinder, wherein the working chamber at the side of the second cylinder has a greater volumetric capacity than that of the working chamber at the side of the first cylinder;

a communication passage is provided in the intermediate closing member, the communication passage allowing the discharge-side working chamber at the side of the first cylinder and the suction-side working chamber at the side of the second cylinder to be communicated with each other to form an expansion chamber; and an injection passage for introducing further the working fluid into the expansion chamber;

wherein an introduction outlet of the injection passage leading to the expansion chamber is provided at a position on the first closing member or the second closing member, the position being located inwardly away from the inner circumferential surface of the first cylinder or the second cylinder in such a manner that the injection passage and the discharge passage are not in communication with each other and the introduction outlet is provided at a position that allows the injection passage to open only into the expansion chamber by opening and closing of the introduction outlet by the movement of the first piston or second piston.

8. The rotary expander according to claim 7, wherein the introduction outlet is provided on the first closing member, and the position of the introduction outlet is within a range of angles from the first partition member to 90 degrees in an opposite direction of the rotation of the shaft.

9. The rotary expander according to claim 7, wherein the introduction outlet is provided on the second closing member, and the position of the introduction outlet is within a range of angles from the second partition member to 90 degrees in a direction of the rotation of the shaft.

10. The rotary expander according to claim 9, wherein the introduction outlet is closed completely by the lower end surface of the second piston immediately before the contact point between the second piston and the inner circumferential surface of the second cylinder reaches a discharge port of the discharge passage, and the introduction outlet is closed by the lower end surface of the second piston at least a period from the start of the discharge process to the end thereof.

11. The rotary expander according to claim 7, wherein the shaft is coupled to a compression mechanism for compressing the working fluid.

12. The rotary expander according to claim 7, wherein the working fluid is carbon dioxide.

* * * * *